US010982573B2

(12) United States Patent
Beerens et al.

(10) Patent No.: US 10,982,573 B2
(45) Date of Patent: Apr. 20, 2021

(54) METHOD FOR MOUNTING A VALVE SEAT RING ON A CYLINDER HEAD OF AN INTERNAL COMBUSTION ENGINE

(71) Applicant: MAHLE International GmbH, Stuttgart (DE)

(72) Inventors: Christoph Beerens, Stuttgart (DE); Heiko Heckendorn, Schopfheim (DE)

(73) Assignee: MAHLE International GmbH, Stuttgart (DE)

( * ) Notice: Subject to any disclaimer, the term of this patent is extended or adjusted under 35 U.S.C. 154(b) by 0 days.

(21) Appl. No.: 16/656,403

(22) Filed: Oct. 17, 2019

(65) Prior Publication Data

US 2020/0131952 A1 Apr. 30, 2020

(30) Foreign Application Priority Data

Oct. 24, 2018 (DE) ..... 10 2018 218 241.8

(51) Int. Cl.
*F02F 1/42* (2006.01)
*F01L 3/04* (2006.01)
*F02F 1/24* (2006.01)

(52) U.S. Cl.
CPC *F01L 3/04* (2013.01); *F02F 1/24* (2013.01); *F01L 2303/00* (2020.05); *F02F 2200/00* (2013.01)

(58) Field of Classification Search
CPC ..... F01L 3/22; F01L 3/02; Y10T 29/49306; Y10T 29/49409
USPC ..... 123/193.5
See application file for complete search history.

(56) References Cited

U.S. PATENT DOCUMENTS 4,424,953 A * 1/1984 Takagi ..... B22F 7/06 123/188.8
4,546,737 A * 10/1985 Kazuoka ..... B22F 7/06 123/188.8
4,723,518 A * 2/1988 Kawasaki ..... F01L 3/22 123/188.3
5,020,490 A * 6/1991 Seko ..... F01L 3/22 123/188.8
5,586,530 A * 12/1996 Adachi ..... F01L 3/22 123/188.3
5,745,993 A * 5/1998 Adachi ..... F01L 3/22 29/888.44
5,802,716 A 9/1998 Nishimura et al.
(Continued)

FOREIGN PATENT DOCUMENTS

DE 4029881 A1 4/1992
DE 69502368 T2 11/1998
(Continued)

*Primary Examiner* — Long T Tran
*Assistant Examiner* — James J Kim
(74) *Attorney, Agent, or Firm* — Falk Ewers; Ewers IP Law PLLC

(57) ABSTRACT

A method for mounting a valve seat ring on a cylinder head of an internal combustion engine includes providing a valve seat ring, which has a ring height, and which is measured along an axial direction. The valve seat ring includes a support portion made of a support material and a functional portion made of a functional material. The valve seat ring is arranged on the cylinder head and the support portion of the support material is at least partially removed, so that the ring height of the valve seat ring is reduced.

12 Claims, 1 Drawing Sheet

(56) References Cited

U.S. PATENT DOCUMENTS

| | | | | |
|---|---|---|---|---|
| 6,138,351 | A * | 10/2000 | Adachi | F01L 3/22 29/888.44 |
| 10,584,618 | B2 * | 3/2020 | Hashimoto | C22C 38/24 |
| 2007/0101964 | A1 * | 5/2007 | Morimoto | C23C 8/10 123/188.8 |
| 2016/0375494 | A1 * | 12/2016 | Beerens | B22F 7/02 251/368 |
| 2019/0143415 | A1 * | 5/2019 | Kohler | F01L 3/02 251/368 |

FOREIGN PATENT DOCUMENTS

| | | | |
|---|---|---|---|
| DE | 69626561 | T2 | 9/2003 |
| DE | 102016006392 | A1 | 11/2016 |
| DE | 102016109539 | A1 | 12/2017 |

* cited by examiner

METHOD FOR MOUNTING A VALVE SEAT RING ON A CYLINDER HEAD OF AN INTERNAL COMBUSTION ENGINE

CROSS REFERENCE TO RELATED APPLICATIONS

This application claims priority to German patent application DE 10 2018 218 241.8, filed Oct. 24, 2018, the entire content of which is incorporated herein by reference.

TECHNICAL FIELD

The disclosure relates to a method for mounting a valve seat ring on a cylinder head of an internal combustion engine and to a tribological system including a valve seat ring, which is mounted by carrying out this method. The disclosure further relates to an internal combustion engine including such a valve eat ring and, alternatively or additionally, including such a tribological system.

BACKGROUND

It is known to powder metallurgically produce valve seat rings for inlet and outlet valves including a functional portion and a support portion. While the functional portion is wear-resistant, among other things, the support portion contributes to the creep resistance of the valve seat ring and prevents the latter from falling out of the accommodation, which is provided for the valve seat ring on the cylinder head. In addition, the production costs are lowered with the use of a cost-efficient support material.

After the production, the so-called "double layer" valve seat rings are mounted on accommodations of cylinder heads provided for valve seat rings. The valve seat rings are thereby pressed into the accommodation, support portion first, and the functional portion facing away from the cylinder head is finished to ensure the concentricity of valve seat ring and accommodation, and a captive contact between valve body and valve seat ring. Such valve seat rings are known, for example, from DE102016109539A1.

Valve seat rings having a small ring height, in particular having a ring height of less than 4 millimeters (mm), prove to be advantageous for load change ratios of an internal combustion engine, but also to be advantageous for a cooling of the cylinders due to a smaller provided distance to a water jacket of the internal combustion engine. To produce valve seat rings having low ring height, however, new mounting and production plants need to usually be provided or the production costs need to be raised. In addition, deformations and improper mounting results more easily when arranging valve seat rings having a low ring height.

SUMMARY

It is an object of the present disclosure to provide an improved or at least alternative method for mounting a valve seat ring on a cylinder head of an internal combustion engine. More cost-efficient valve seat rings and those, which have a lower ring height, are to in particular be mounted by such a method, wherein the above-mentioned disadvantages are eliminated or at least reduced.

This object is achieved by a method for mounting a valve seat ring on a cylinder head of an internal combustion engine as described herein.

It is a general idea of the disclosure to arrange a valve seat ring including a support portion made of a support material and including a functional portion made of a functional material on a cylinder head, and to reduce the axial ring height by removing the support material. A valve seat ring having a lower height can be mounted in this way on a cylinder head, which is located closer to the water jacket and which has better cooling properties, wherein the mounting and production plants can be used for valve seat rings having non-reduced ring height. The provision of new mounting and production plants can thus be avoided and production costs are also reduced by using the support material.

A method according to the disclosure serves the purpose of mounting a valve seat ring on a cylinder head of an internal combustion engine. According to the method, a valve seat ring is provided, which has a ring height, which is measured along an axial direction, wherein the valve seat ring includes a support portion made of a support material and a functional portion made of a functional material. This valve seat ring is arranged on the cylinder head. The support portion formed by the support material is subsequently removed at least partially, so that the ring height of the valve seat ring is reduced.

Particularly, a first axial end portion of the valve seat ring facing the cylinder head is at least partially formed by the functional portion, and a second axial end portion of the valve seat ring facing away from the cylinder head is at least partially formed by the support portion. In the case of this alternative, the support portion can be accessed particularly well for removal in response to the finishing after the arranging of the valve seat ring on the cylinder head.

According to an exemplary embodiment, a separating surface between the functional portion and the support portion runs at least in portions along a radial direction of the valve seat ring. This proves to be particularly advantageous for the arranging of the functional and support material along the direction of the force of gravity in response to a powder metallurgical production of the valve seat ring, which is mounted according to the method according to the disclosure.

According to a further exemplary embodiment, the separating surface between the functional portion and the support portion runs at least in portions along the axial direction of the valve seat ring. This also proves to be particularly advantageous for the production costs of the valve seat ring, which is mounted according to the method according to the disclosure, because support material, which is a great deal more cost-efficient, can be used in this way.

Advantageously, the functional portion abuts at least partially against an inner jacket surface of the cylinder head. In the case of this alternative, the support portion can also be accessed particularly well for an operator or the used finishing tool, respectively, after the arranging of the valve seat ring on the cylinder head for removal of the support material as part of the finishing.

Particularly advantageously, the removal of the support portion takes place in such a way that a boundary surface to the functional portion facing the support portion is at least partially exposed. This exemplary embodiment provides for a particularly cost-efficient production of the valve seat ring, which is mounted according to the disclosure, and for a particularly simple mounting of the valve seat ring.

According to an exemplary embodiment, the functional portion made of the functional material is also at least partially removed in addition to the at least partial removal of the support portion made of the support material. This provides for a particularly simple mounting of the valve seat ring.

Advantageously, the ring height measured along the axial direction is a ring height, which is formed at its maximum with respect to a radial direction of the valve seat ring.

The disclosure also relates to a tribological system, which includes a valve seat ring mounted according to the above-presented method. The above-described advantages of the method according to the disclosure and of the valve seat ring mounted according to the method according to the disclosure thus also transfer to the tribological system according to the disclosure.

The disclosure further relates to an internal combustion engine for a motor vehicle. The internal combustion engine includes a valve seat ring mounted according to the above-presented method, and, alternatively or additionally, an above-presented tribological system. The above-described advantages of the method according to the disclosure, of the valve seat ring mounted according to the method according to the disclosure, and of the tribological system according to the disclosure, thus also transfer to the internal combustion engine according to the disclosure.

Further important features and advantages of the disclosure follow from the drawings and from the corresponding figure description on the basis of the drawings.

It goes without saying that the above-mentioned features and the features, which will be described below, cannot only be used in the respective specified combination, but also in other combinations or alone, without leaving the scope of the present disclosure.

BRIEF DESCRIPTION OF THE DRAWINGS

The disclosure will now be described with reference to the drawings wherein.

DESCRIPTION OF EXEMPLARY EMBODIMENTS

Figure 1:
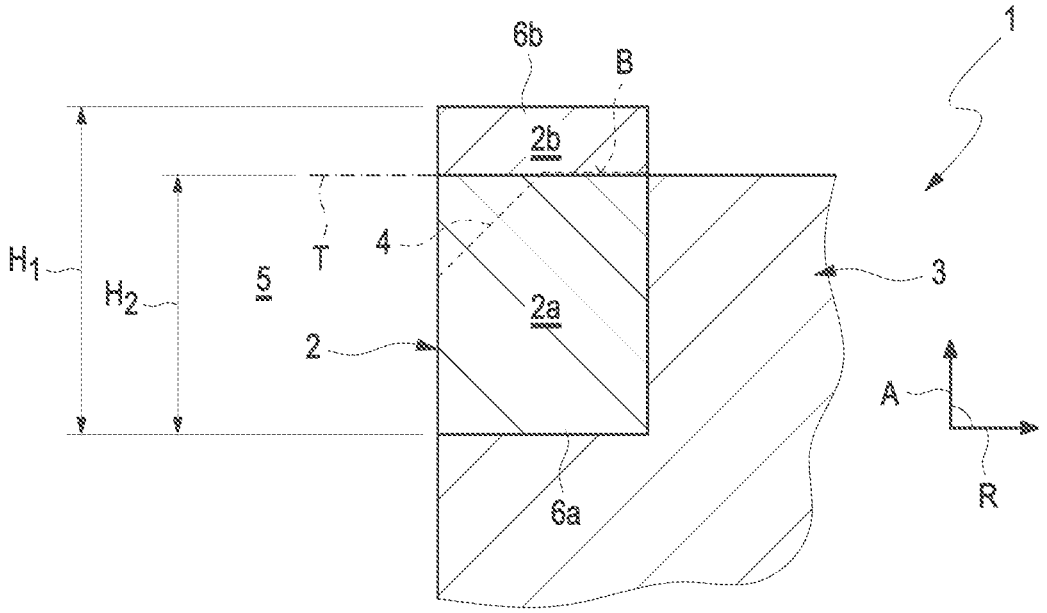
FIG. 1 shows a sectional view of a valve seat ring in a cross section along an axial direction of the valve seat ring according to a first exemplary embodiment of the disclosure.

FIG. 1 shows a simplified valve seat arrangement 1 including a valve seat ring 2 mounted on a cylinder head 3 of an internal combustion engine according to a first exemplary embodiment of the disclosure. The valve seat ring 2 surrounds a valve opening 5, which can be closed by a valve body (not shown in FIG. 1) and which has a ring height $H_1$ measured along an axial direction (A). In this first exemplary embodiment, the valve seat ring 2 includes a functional portion 2*a* made of functional material, which is arranged on a first axial end portion 6*a* of the valve seat 2 facing the cylinder head 3, and a support portion 2*b* made of support material, which is arranged on a second axial end portion 6*b* of the valve seat ring 2 facing away from the cylinder head 3. The functional portion 2*a* and the support portion 2*b* are separated by a separating surface T, which is arranged between the functional portion 2*a* and the support portion 2*b*. In the exemplary embodiment shown in FIG. 1, the separating surface T runs along a radial direction R of the valve seat ring 2. The functional portion 2*a* abuts against an inner jacket surface of the cylinder head 3.

Figure 2:
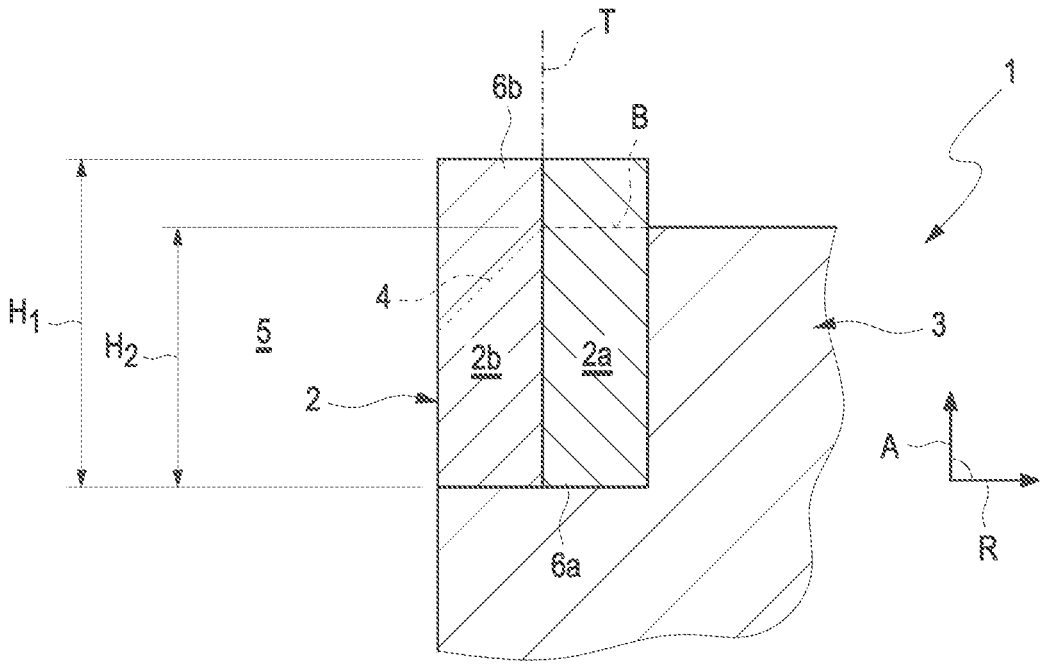
FIG. 2 shows a sectional view of a valve seat ring in a cross section along an axial direction of the valve seat ring according to a second exemplary embodiment of the disclosure.

FIG. 2 illustrates a simplified valve seat arrangement 1 including a valve seat ring 2 mounted on a cylinder head 3 of an internal combustion engine according to a second exemplary embodiment of the disclosure. The valve seat ring 2 of the second example also includes a functional portion 2*a* made of functional material and a support portion 2*b* made of support material, which are separated by a separating surface T, which is arranged between the functional portion 2*a* and the support portion 2*b*. In this second exemplary embodiment, the functional portion 2*a* as well as the support portion 2*b* are arranged on both axial end portions 6*a* and 6*b*. In the exemplary embodiment shown in FIG. 2, the separating surface T runs along a radial axial direction A of the valve seat ring 2.

The method according to the disclosure will be described below in an exemplary manner on the basis of FIGS. 1 and 2:

After arranging the valve seat ring 2 on the cylinder head 3, the support portion 2*b* is at least partially removed in response to the finishing, so that the ring height $H_1$ is reduced to the lower ring height $H_2$. The functional portion 2*a* is also at least partially removed in response to the finishing. A dashed line shows the surface B, which limits the valve seat ring 2 after the removal of the functional and support portion 2*a* and 2*b*. A portion of the surface B, which is inclined to the axial direction A, forms the valve seat 4, against which a valve plate (not shown in FIGS. 1 and 2) of the valve body abuts in a closed position of the valve body.

The valve seat ring 2 can be produced in a powder metallurgically manner, in particular monolithically. The functional portion 2*a* can be such that it is wear- and heat-resistant, and the support portion 2*b* can be such that it can be removed easily in response to the finishing, and, alternatively or additionally, is creep- and heat-resistant, and, alternatively or additionally, cost-efficient.

It is understood that the foregoing description is that of the exemplary embodiments of the disclosure and that various changes and modifications may be made thereto without departing from the spirit and scope of the disclosure as defined in the appended claims.

What is claimed is:

1. A method for mounting a valve seat ring on a cylinder head of an internal combustion engine, the method comprising:

a) providing the valve seat ring having a ring height measured along an axial direction, the valve seat ring including a support portion made of a support material and a functional portion made of a functional material;

b) arranging the valve seat ring on the cylinder head; and c) at least partially removing the support portion made of the support material, such that the ring height of the valve seat ring is reduced, and both the support portion and the functional portion at least partially abut a surface of the cylinder head.

2. The method according to claim 1, further comprising: after performing step b):

at least partially forming a first axial end portion of the valve seat ring facing the cylinder head by the functional portion; and at least partially forming a second axial end portion of the valve seat ring facing away from the cylinder head by the support portion.

3. The method according to claim 1, wherein a separating surface between the functional portion and the support portion runs at least in portions along a radial direction of the valve seat ring.

4. The method according to one of claim 3, wherein the separating surface between the functional portion and the support portion runs at least in portions along the axial direction of the valve seat ring.

5. The method according to claim 1, wherein:

after performing step b), the support portion and the functional portion are arranged next to one another along the axial direction.

6. The method according to claim 1, further comprising:

after performing step b), abutting the functional portion at least partially against an inner jacket surface of the cylinder head.

7. The method according to claim 1, further comprising:

performing the at least partially removing of the support portion in step c) in such a way that a boundary surface of the functional portion facing the support portion is at least partially exposed.

8. The method according to claim 1, further comprising:

in step c), at least partially removing the functional portion made of the functional material in addition to the at least partially removing of the support portion made of the support material.

9. The method according to claim 1, wherein the ring height measured along the axial direction is the ring height formed at its maximum with respect to a radial direction of the valve seat ring.

10. A tribological system, comprising:

the valve seat ring produced according to claim 1.

11. The internal combustion engine for a motor vehicle, comprising:

at least one cylinder; and the valve seat ring being mounted according to claim 1.

12. The internal combustion engine for a motor vehicle, comprising:

a tribological system according to claim 10.

* * * * *